US008910427B2

(12) United States Patent
Clisset

(10) Patent No.: US 8,910,427 B2
(45) Date of Patent: Dec. 16, 2014

(54) ROOFTOP SNOW STOP APPARATUS

(71) Applicant: Steven P. Clisset, Erie, CO (US)

(72) Inventor: Steven P. Clisset, Erie, CO (US)

(73) Assignee: Steven P. Clisset, Erie, CO (US)

( * ) Notice: Subject to any disclaimer, the term of this patent is extended or adjusted under 35 U.S.C. 154(b) by 0 days.

(21) Appl. No.: 13/733,869

(22) Filed: Jan. 3, 2013

(65) Prior Publication Data

US 2013/0167453 A1 Jul. 4, 2013

Related U.S. Application Data

(60) Provisional application No. 61/582,577, filed on Jan. 3, 2012.

(51) Int. Cl.
*E04D 13/10* (2006.01)

(52) U.S. Cl.
CPC ..... *E04D 13/10* (2013.01)
USPC ..... 52/24; 52/26

(58) Field of Classification Search
USPC ..... 52/24–26
See application file for complete search history.

(56) References Cited

U.S. PATENT DOCUMENTS

| | | | | |
|---|---|---|---|---|
| 3,296,750 | A | 1/1967 | Zaleski | |
| 5,371,979 | A | 12/1994 | Kwiatkowski et al. | |
| D360,476 | S | 7/1995 | Smeja et al. | |
| 5,664,374 | A | 9/1997 | Lee | |
| 5,901,507 | A | 5/1999 | Smeja et al. | |
| 5,943,826 | A * | 8/1999 | Totin | 52/24 |
| 6,070,368 | A * | 6/2000 | Anderson | 52/24 |
| D499,331 | S | 12/2004 | Dressler | |
| 6,922,948 | B2 * | 8/2005 | Smeja et al. | 52/24 |
| 7,127,867 | B2 * | 10/2006 | Smeja et al. | 52/745.21 |
| 7,516,576 | B1 | 4/2009 | Mullane | |
| 7,997,032 | B2 * | 8/2011 | Riley et al. | 52/24 |
| 2005/0115162 | A1 * | 6/2005 | Nee | 52/24 |
| 2006/0010786 | A1 | 1/2006 | Rogers | |
| 2007/0271855 | A1 * | 11/2007 | Stearns | 52/24 |

* cited by examiner

*Primary Examiner* — Elizabeth A Plummer
(74) *Attorney, Agent, or Firm* — Neugeboren O'Dowd PC

(57) ABSTRACT

This disclosure describes a snow stop, and methods of manufacture and use, that can be manufactured in a flat and easily transportable form and then hand-folded into a folded snow stop at an installation site. The snow stop is formed in a flat chevron shape that is stackable so as to ease transportation of large numbers of snow stops to an installation site. The snow stop includes first, second, and third fold lines enabling installers to hand fold the flat snow stops into folded snow stops in a repeatable manner. The snow stops can further include raised portions that can delineate and form the fold lines and increase structural integrity of the folded snow stop.

4 Claims, 15 Drawing Sheets

ROOFTOP SNOW STOP APPARATUS

CLAIM OF PRIORITY UNDER 35 U.S.C. §119

The present Application for Patent claims priority to Provisional Application No. 61/582,577 entitled "ROOFTOP SNOW STOP APPARATUS" filed Jan. 3, 2012, and assigned to the assignee hereof and hereby expressly incorporated by reference herein.

FIELD OF THE DISCLOSURE

The present disclosure relates generally to snow stops. In particular, but not by way of limitation, the present disclosure relates to systems, methods and apparatuses for snow retaining devices that are easy to carry and foldable into final form before installation.

BACKGROUND

Other inventions are a combination of a base mounting plate with a vertical face perpendicular to the flow of snow and snow melt on the roof or a system of brackets that attached to either the roof surface with adhesives and/or fasteners or to the ribs of standing seam metal roof systems with rods that attach through or to those brackets creating a horizontal railing.

On those of the first type the uphill vertical edge of the base is usually perpendicular to the roof fall line and is therefore particularly susceptible to the effects of constant water flow and ice buildup making them susceptible to leakage or complete failure of the snow stop to remain attached to the roof. Even those that are diamond shaped (e.g., MOUNTAIN SNOW STOPS <http://www.snow stops.net/>) and thus can be mounted at an angle to the flow of water generally have bases that are large in area and cause the flow of snow melt water to have to flow around them after running into the snow stop. The greater the roof area above the snow stop the larger the amount of moisture impacting the base on which the vertical face that controls the snow from sliding is mounted.

Additionally the manufacture of the prior art is such that it typically requires multiple parts that require labor intensive steps to create a snow barricade railing or bulky molded pieces that are often fully formed prior to purchase and installation.

Thus, prior art snow stops are prone to mechanical failure due to snowmelt water pressure and are expensive.

SUMMARY OF THE DISCLOSURE

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

Some embodiments of the disclosure may be characterized as a snow stop. The snow stop can include a first foot, a first stopping portion, a second stopping portion, and a second foot. The first foot can be configured for securing to a structure. The first stopping portion can be coupled to the first foot via a first fold line. The second stopping portion can be coupled to the first stopping portion via a second fold line.

The first and second stopping portions can be arranged so as to impede snow and ice movement down a fall line of the structure. A triangular opening can exist between bottom edges of the first and second stopping portions and a bottom of the snow stop. The triangular opening can be large enough to enable snow melt to run through the triangular opening. The second foot can be coupled to the second stopping portion via a third fold line, where the second foot is configured for securing to the structure.

Other embodiments of the disclosure may also be characterized as a flat snow stop configured for transport in a flat form and configured to then be bent by hand into a folded snow stop at an installation site. The flat snow stop can include a chevron-shaped foldable component having a greater width than thickness and being separated into a first foot having a first raised portion, a second foot having a second raised portion, a first stopping portion having a third raised portion, and a second stopping portion having a fourth raised portion. The flat snow stop can further include a first, second, and third fold lines. The first fold line can be formed by and between the first and third raised portions. The second fold line can be formed by and between the second and fourth raised portions. The third fold line can be formed by and between the third and fourth raised portions.

Other embodiments of the disclosure can be characterized as a method of manufacturing a flat snow stop. The method can include forming a chevron-shaped foldable component having greater width than thickness. The method can further include pressing at least four raised portions into the chevron-shaped foldable component so as to form the following: (1) a first foot including a first of the four raised portions; (2) a second foot including a second of the four raised portions; (3) a first stopping portion separated from the first foot by a first fold line, the first stopping portion including a third of the four raised portions; and (4) a second stopping portion separated from the first stopping portion by a third fold line and including a fourth of the four raised portions.

BRIEF DESCRIPTION OF THE DRAWINGS

Various objects and advantages and a more complete understanding of the present invention are apparent and more readily appreciated by referring to the following detailed description and to the appended claims when taken in conjunction with the accompanying drawings:

DETAILED DESCRIPTION

The present disclosure relates generally to snow stops. More specifically, but without limitation, the present disclosure relates to hand-bendable flat snow stops.

The word "exemplary" is used herein to mean "serving as an example, instance, or illustration." Any embodiment described herein as "exemplary" is not necessarily to be construed as preferred or advantageous over other embodiments.

To overcome the challenges described in the prior art, the present disclosure describes systems, methods, and apparatuses for a snow stop, snow guard, snow cleat or snow retaining device configured to allow snowmelt water to pass through, under, or around the snow stop rather than building up water pressure against the snow stop. The snow stop is also manufactured in a flat form that is easily transported in stacks to an installation site, and then can be hand-folded into a folded snow stop atop a roof by an installer. Also, the systems, methods, and apparatuses of the present disclosure accomplish this task at substantially less cost and requiring less labor than was possible in the art.

Figure 6:
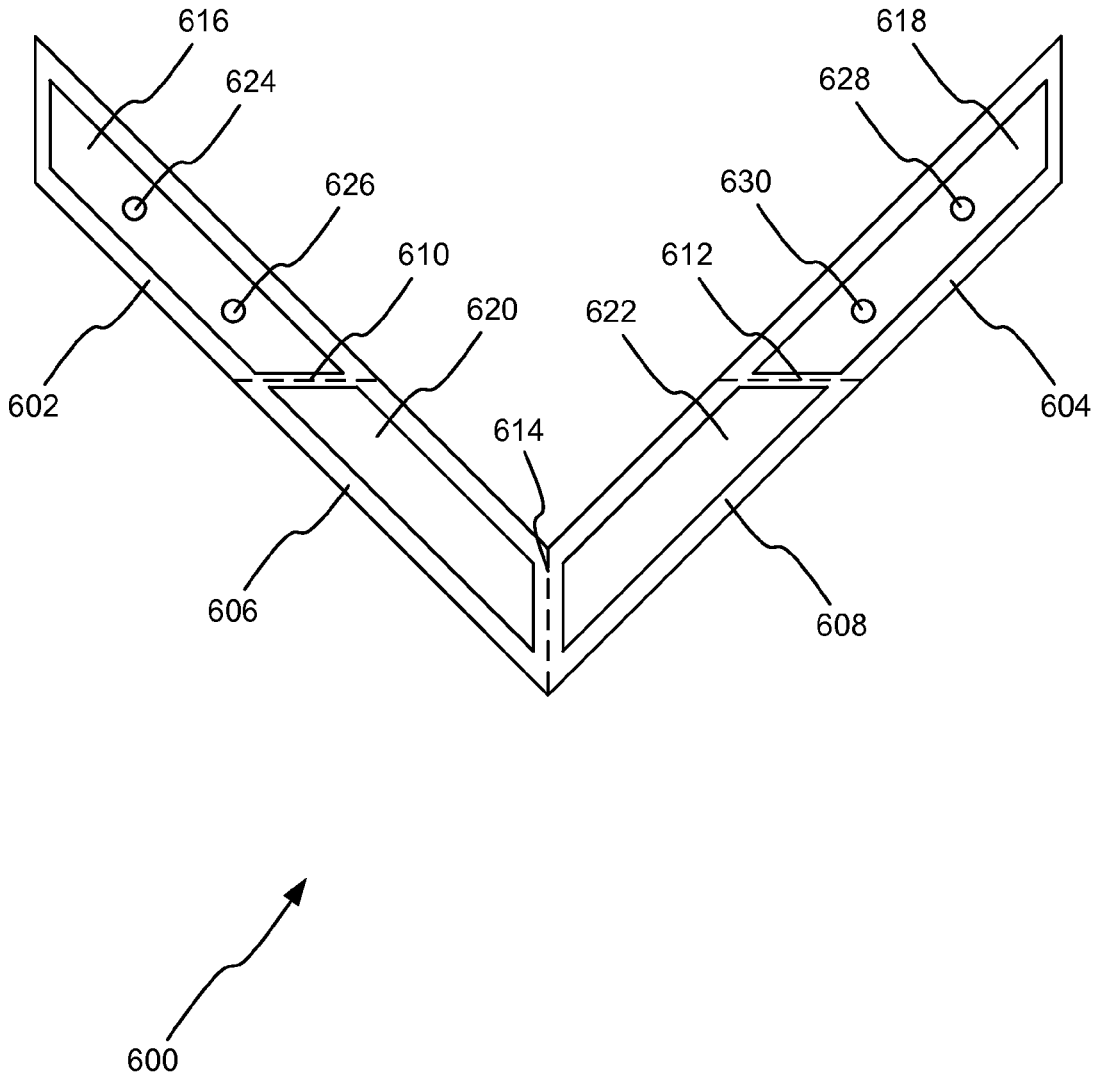
FIG. 6 illustrates an overhead view of a flat snow stop having raised portions according to another embodiment of this disclosure.

FIG. 6 illustrates an overhead view of a flat snow stop 600 having raised portions according to one embodiment of this disclosure. The flat snow stop 600 can have a flat chevron shape having a first foot 602, a second foot 604, a first stopping portion 606, and a second stopping portion 608. The flat snow stop 600 can have a greater width than thickness since it can be manufactured from a stamped or flattened piece/sheet of metal, plastic, or other rigid or semi-rigid material. Between the first foot 602 and the first stopping portion 606 is a first fold line 610. Between the second foot 604 and the second stopping portion 608 is a second fold line 612. Between the first and second stopping portions 606, 608 is a third fold line 614.

The fold lines 610, 612, 614 can be formed by forming raised portions 616, 618, 620, 622 (or strengthening ribs) in each of the first foot 602, second foot 604, first stopping portion 606, and second stopping portion 608. In particular, a first raised portion 616 can be formed in the first foot 602. A second raised portion 618 can be formed in the second foot 604. A third raised portion 620 can be formed in the first stopping portion 606. A fourth raised portion 622 can be formed in the second stopping portion 608. These raised portions 616, 618, 620, 622 can form the first, second, and third fold lines 610, 612, 614 as regions of flat material between the raised portions 616, 618, 620, 622. The raised portions 616, 618, 620, 622 also enhance the rigidity of the flat snow stop 600 once folded into a folded snow stop (see FIG. 1).

The fold lines 610, 612, 614 also demarcate or separate each of the first foot 602, the first stopping portion 606, the second stopping portion 608, and the second foot 604. The fold lines 612, 614, 616, as compared to the raised portions 618, 620, 622, 624 are more easily bent and thus an installer can easily fold the flat snow stop 600 into a finished snow stop 100 by hand and without the use of tools by folding along the fold lines 612, 614, 616. In other words, the flat snow stop 600 will fold preferentially along lines where the raised portions 618, 620, 622, 624 are absent (e.g., the fold lines 612, 614, 616). Moreover, this folding requires little skill since the fold is essentially forced to be along the fold lines 612, 614, 616. The flat snow stop 600 is thus hand-bendable along the fold lines 612, 614, 616 and has greater structural integrity along any line intersecting one or the raised portions 618, 620, 622, 624.

The flat snow stop 600 can be formed from a flat chevron-shaped piece of material such as sheet metal or plastic. The flat snow stop 600 can include one or more fastening apertures for securing the flat snow stop 600 to a structure such as a roof. Exemplary fastening apertures are shown as 624 and 626 in the first foot 602 and as 628 and 630 in the second foot 604. Any number of fastening apertures can be used even though only four are illustrated. The fastening apertures 624, 626, 628, 630 are configured to accept screws, bolts, nails, and other fastening mechanisms the fix the folded snow stop to a roof or other structure.

The flat snow stop 600 can be stacked between (or above or below) one or more other flat snow stops. This is possible even with the raised portions 616, 618, 620, 622, since the raised portions 616, 618, 620, 622 of one flat snow stop can fit into the raised portions of other flat snow stops. In this fashion, the raised portions 616, 618, 620, 622 further serve to help hold a stack of flat snow stops together.

Stacks of flat snow stops can be transported to an installation site, raised or carried to a roof or other structure while stacked (e.g., in a construction belt pouch), and then folded by hand into a folded snow stop by an installer. The folded snow stop can then be secured to a roof or other structure. One key advantage of a stackable design that can be hand-folded into a folded snow stop is that the installers can carry larger numbers of flat snow stop onto the roof or other structure and then fold and install the folded snow stops while making fewer trips down to a truck or other vehicle to obtain more flat snow stops. Prior art snow stops were typically pre-formed and thus larger, less wieldy, and fewer could be taken rooftop at a time.

Figure 5:
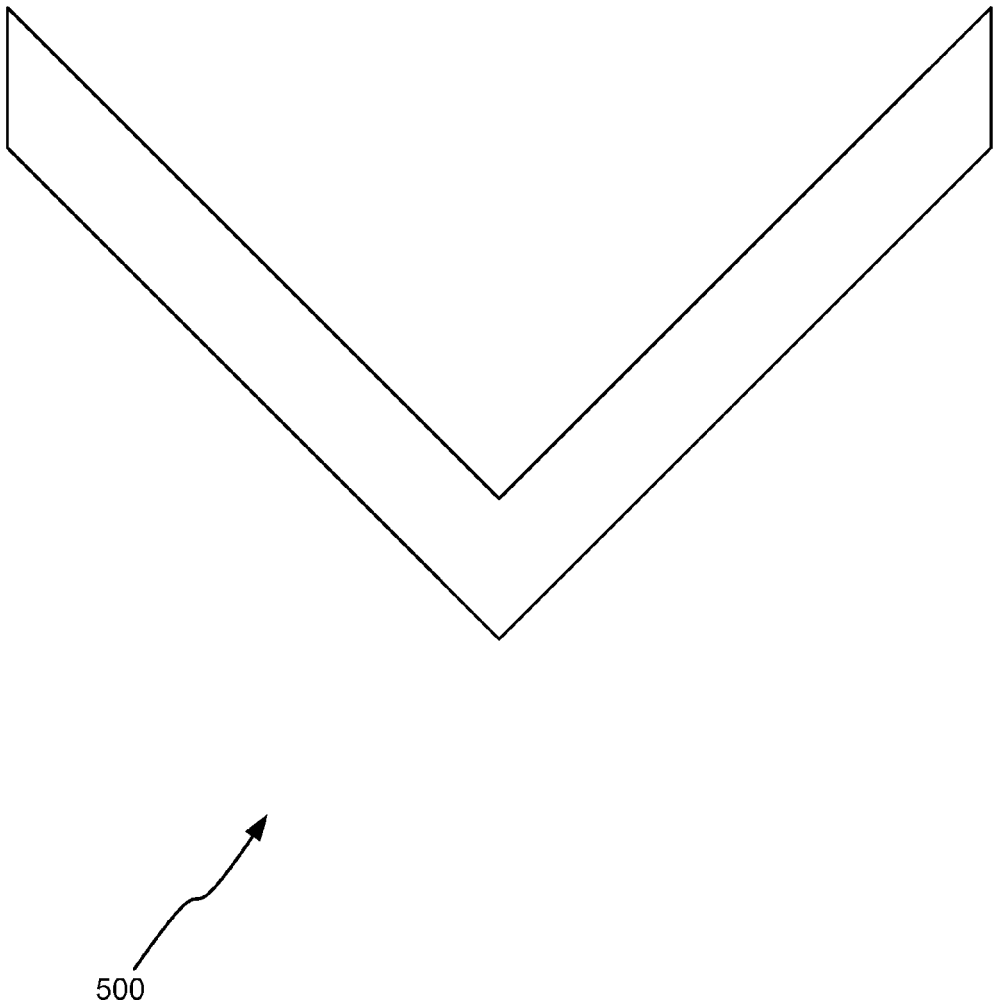
FIG. 5 illustrates an overhead view of a flat snow stop according to one embodiment of this disclosure.

In some embodiments, each of the illustrated raised portions 616, 618, 620, 622 can be replaced with a plurality of smaller raised portions. Any shape and configuration of multiple raised portions can be used as long as the net effect is to leave the most-easily folded lines running along the first, second, and third fold lines 610, 612, 614. In some embodiments, the flat snow stop may be devoid of raised portions as seen in FIG. 5.

Figure 8:
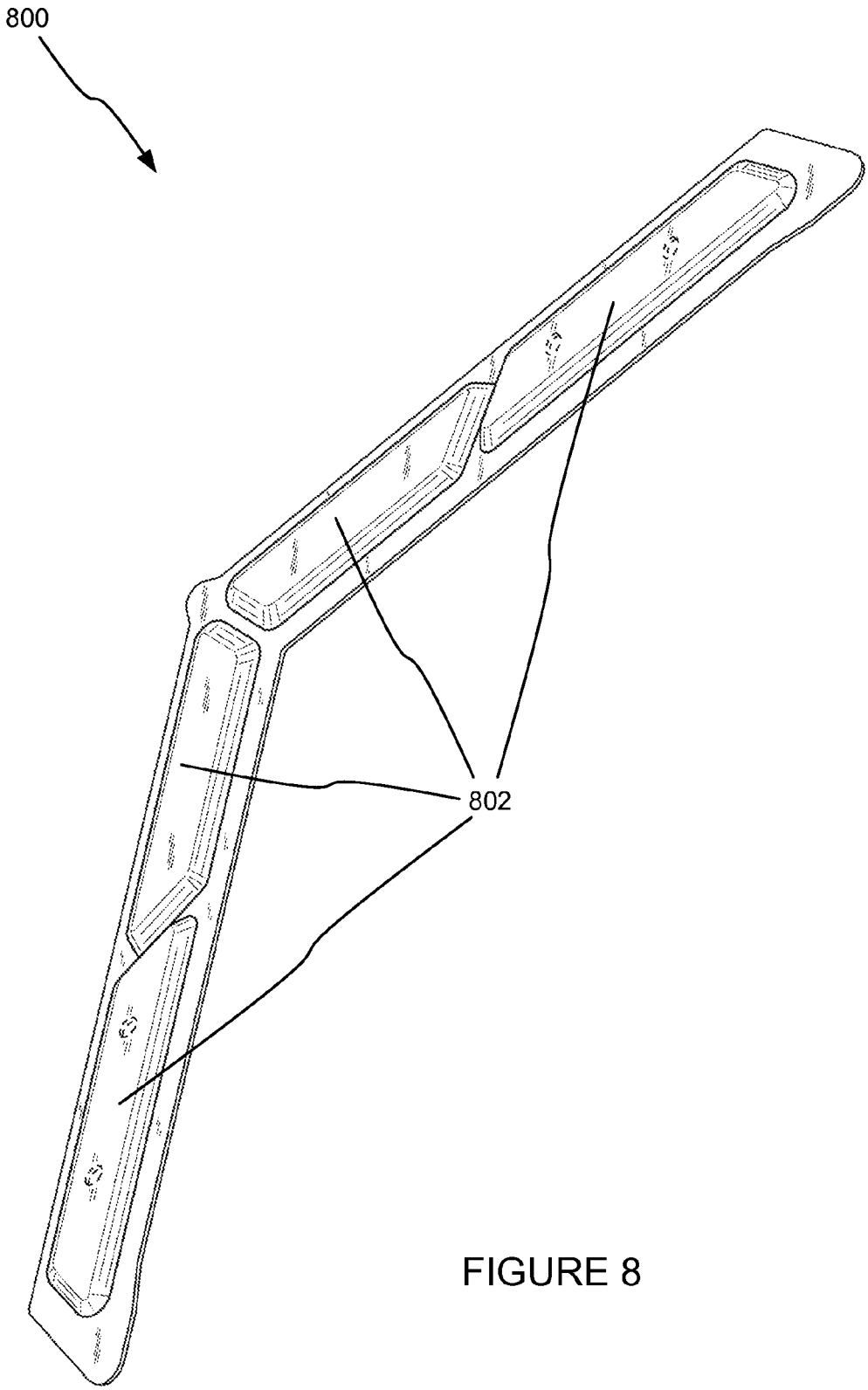
FIG. 8 illustrates a perspective view of one embodiment of a flat snow stop.
Figure 9:
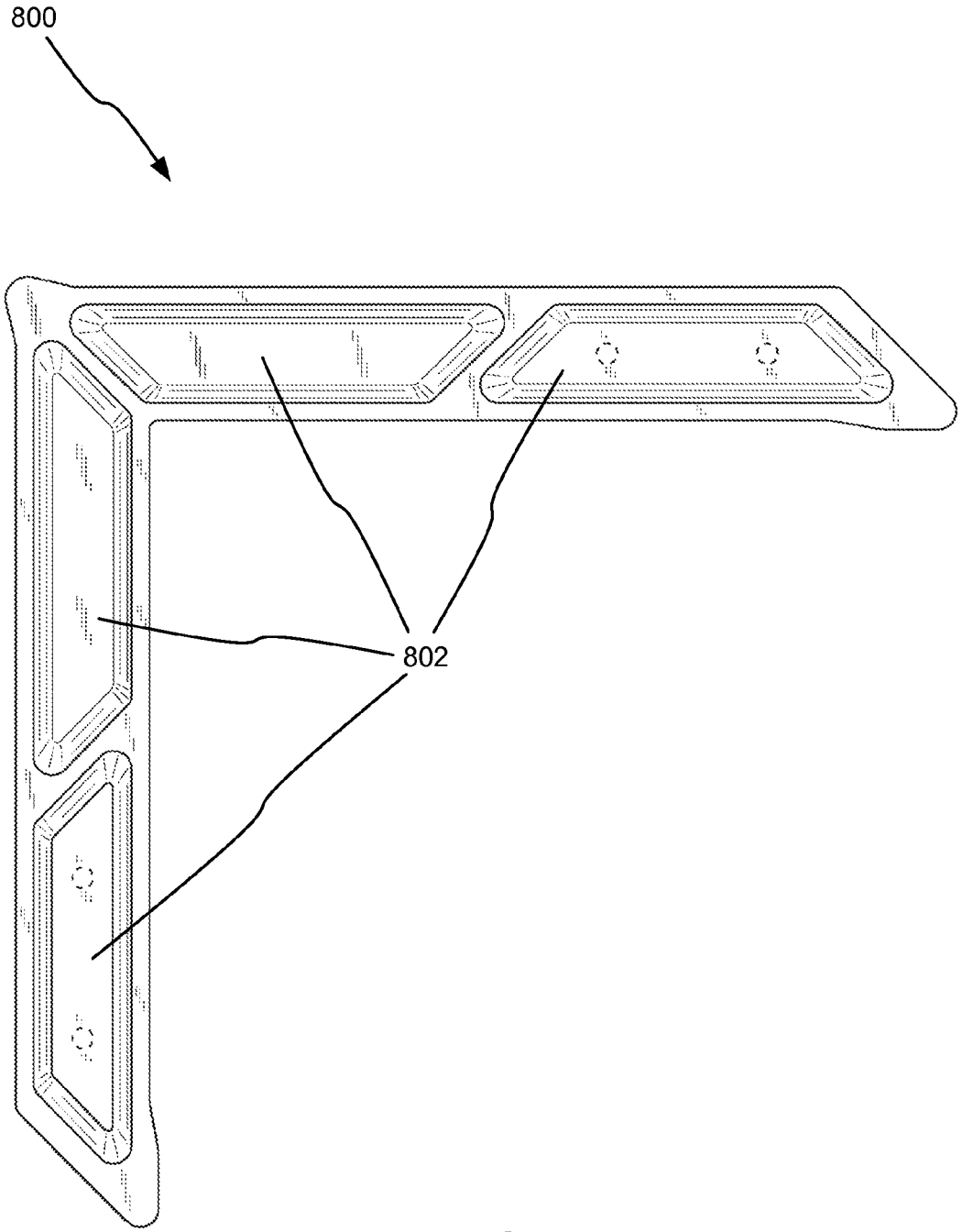
FIG. 9 illustrates an overhead view of the flat snow stop of FIG. 8.
Figure 10:
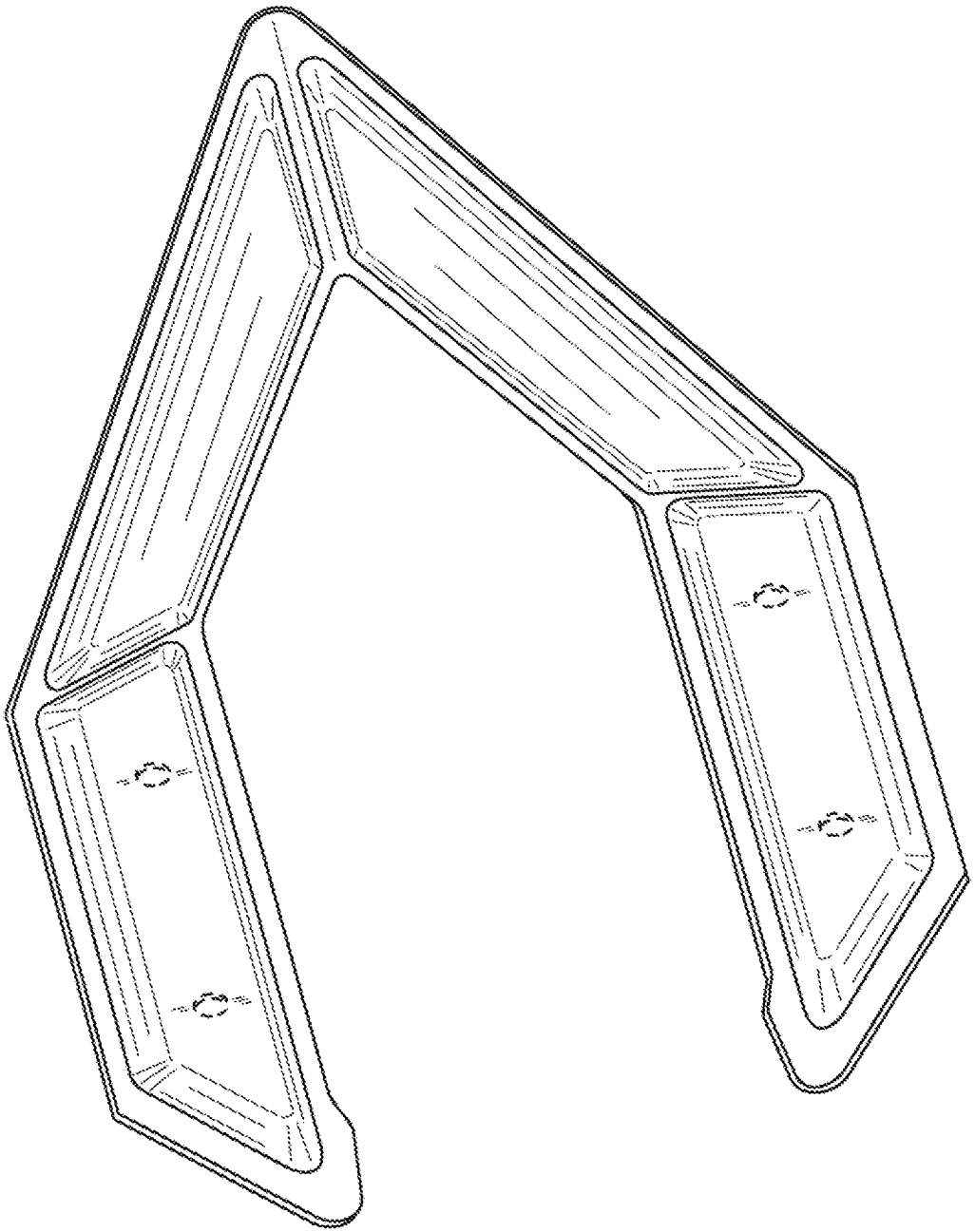
FIG. 10 illustrates a perspective view of one embodiment of a folded snow stop.
Figure 11:
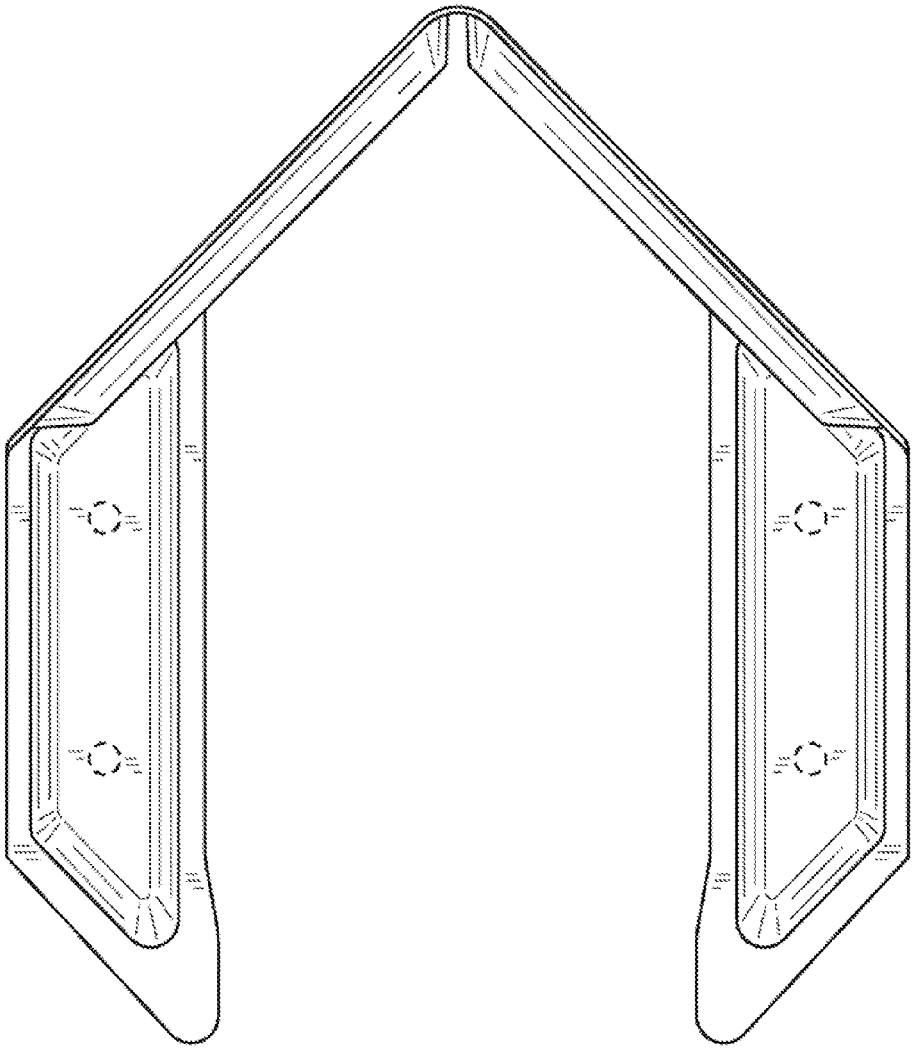
FIG. 11 illustrates an overhead view of the folded snow stop of FIG. 10.
Figure 12:
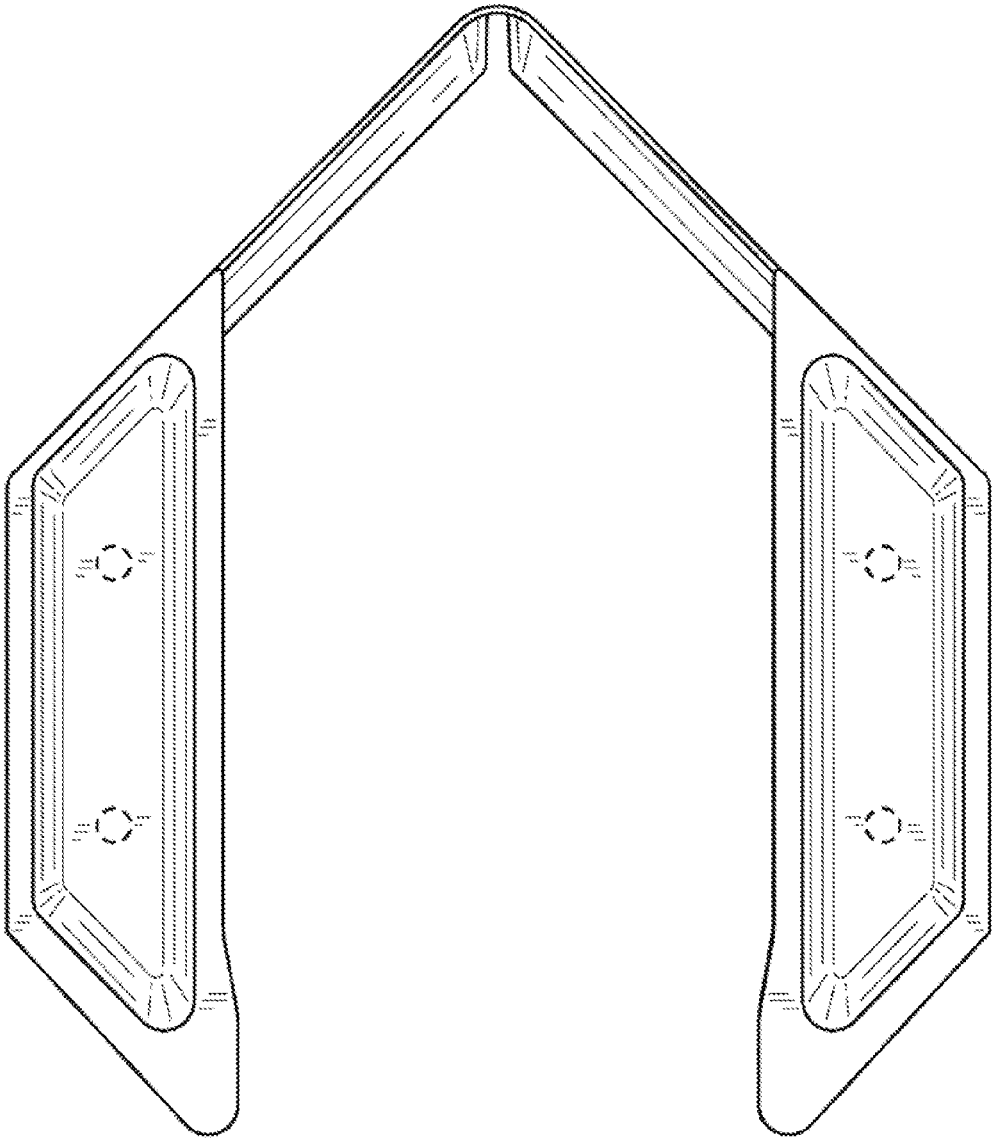
FIG. 12 illustrates a bottom view of the folded snow stop of FIG. 10.
Figure 13:
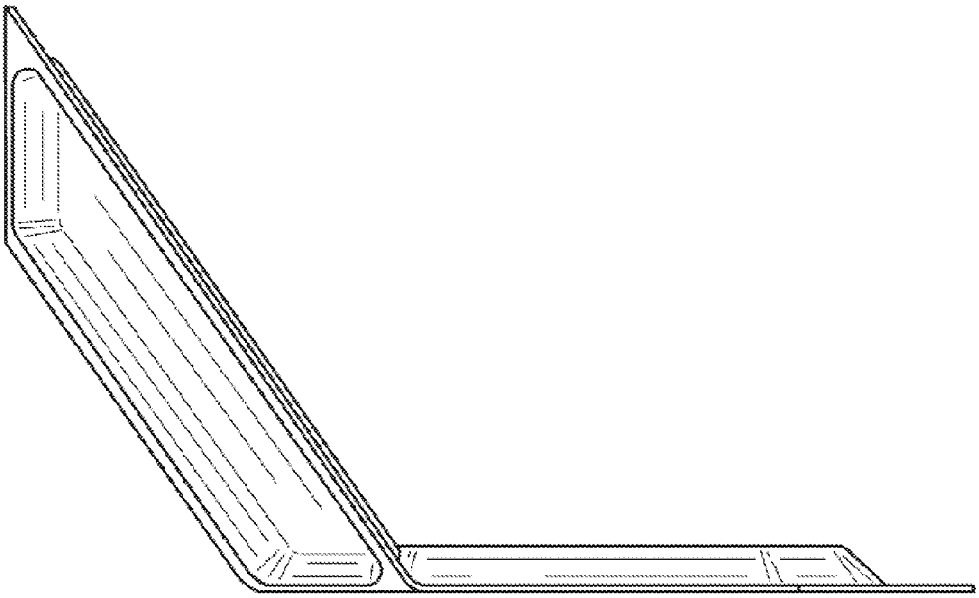
FIG. 13 illustrates a side view of the folded snow stop of FIG. 10.
Figure 14:
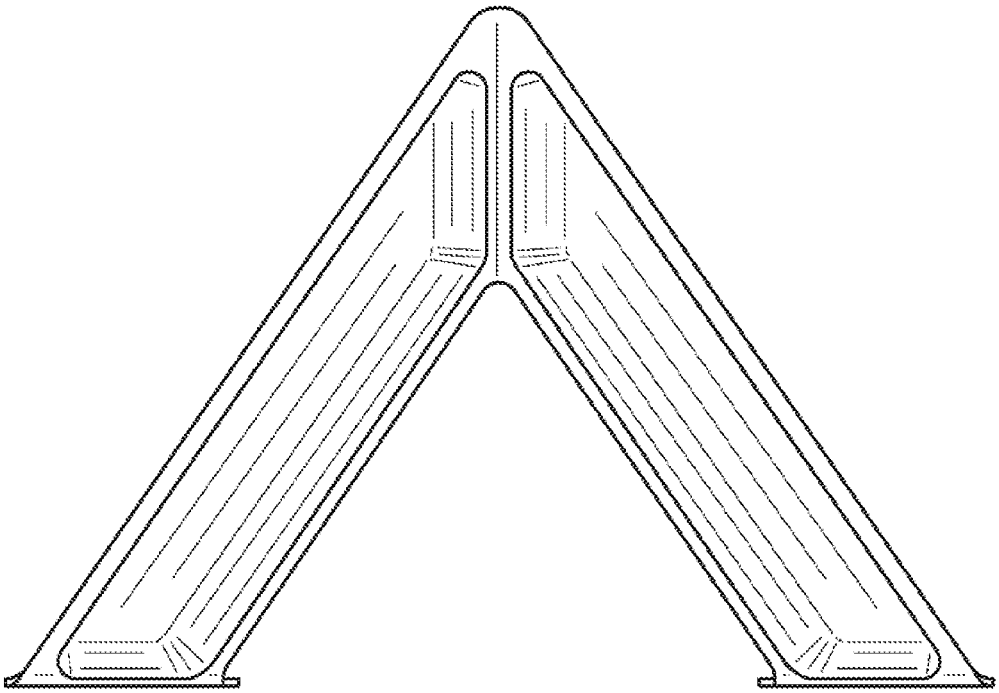
FIG. 14 illustrates a front view of the folded snow stop of FIG. 10.
Figure 15:
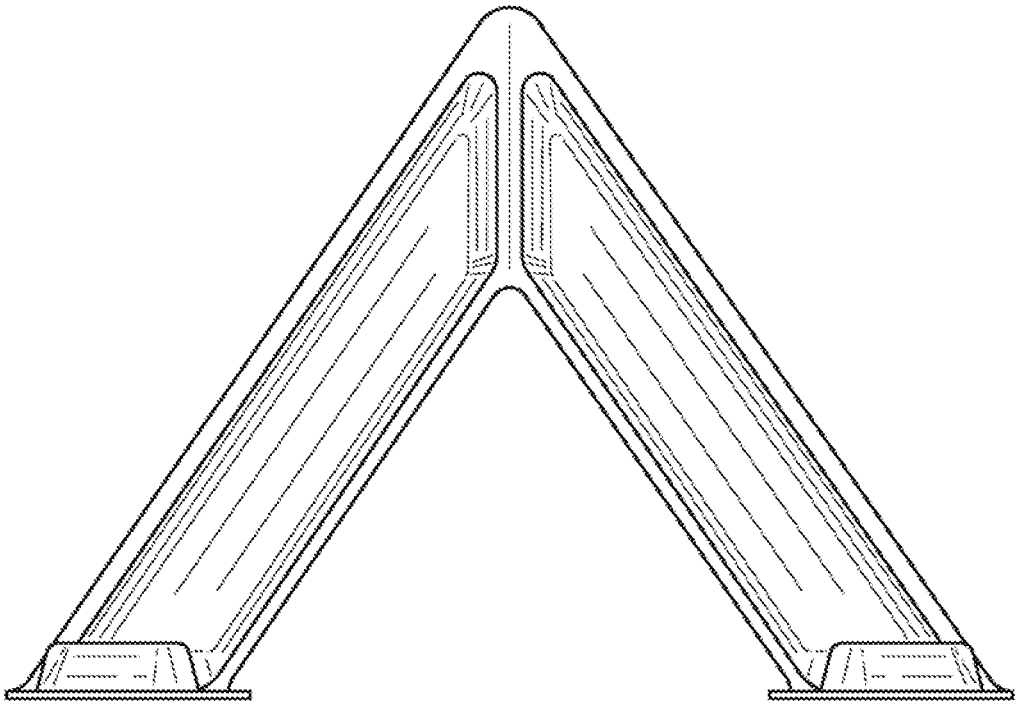
FIG. 15 illustrates a rear view of the folded snow stop of FIG. 10

FIGS. 8 and 9 provide further illustrations of a flat snow stop 800 having four raised portions 802. In this embodiment, the raised portions have rounded edges.

Figure 1:
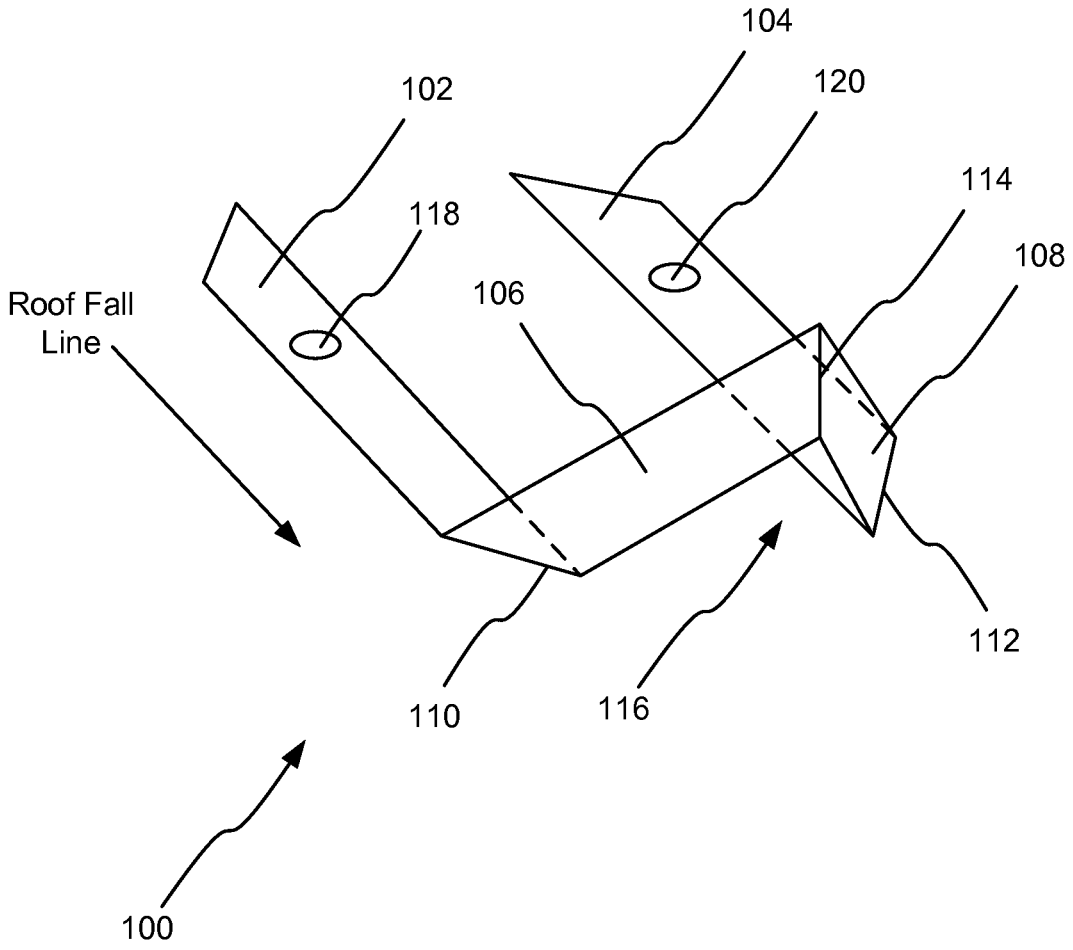
FIG. 1 illustrates a perspective view of an embodiment of a folded snow stop according to one embodiment of this disclosure.

FIG. 1 is a perspective view of an embodiment of a folded snow stop 100 according to one embodiment of this disclosure. The folded snow stop 100 can be folded from a flat snow stop such as 500 in FIG. 5. In other instances, a folded snow stop 100 can be folded from a flat snow stop such as 600 in FIG. 6 having raised portions. In other words, while the folded snow stop 100 does not show any raised portions, variations of the folded snow stop 100 can include the raised portions (e.g., see FIGS. 7 and 10-15). The folded snow stop 100 includes a first foot 102, a second foot 104, a first stopping portion 106, and a second stopping portion 108. The first foot 102 can include a first one or more fastening apertures 118, while the second foot 104 can include a second one or more fastening aperture 120. The feet 102, 104 can be arranged parallel to the flow of water from melting snow and possibly parallel to each other depending on the arrangement of fold lines. The first and second stopping portions 106, 108 can be folded up away from the roof and a bottom of the folded snow stop 100 so as to block the flow of large chunks or volumes of snow and ice moving down the roof. The third fold line 114 can create an angle between the first and second stopping portions 106, 108.

The first and second stopping portions 106, 108 can be arranged so as to leave an opening 116 between a bottom edge of the first and second stopping portions 106, 108 and the roof or other structure. This opening 116 allows melt water to flow through the opening 116 and avoid the snow-water-ice buildup that can cause structural failure in prior art snow stops.

The folded snow stop 100 can be attached to the roof or other structure through the use of adhesives, fasteners (e.g., nails, screws rivets, and bolts to name a few), or a combination of adhesives and fasteners. Fasteners can be arranged through the fastening apertures 110, 112 to secure the folded snow stop 100 to the roof or other structure.

Ends of the feet 102, 104 can be angled (as illustrated) thus avoiding buildup of water and avoiding impeding the flow of water. For instance, in FIG. 2 it can be seen that ends of the feet 102, 104 are angled relative to the direction of flow of water, snow, and ice. As seen, the legs 102, 104 can be parallel to a direction of water flow or the direction of the roof fall line.

Figure 2:
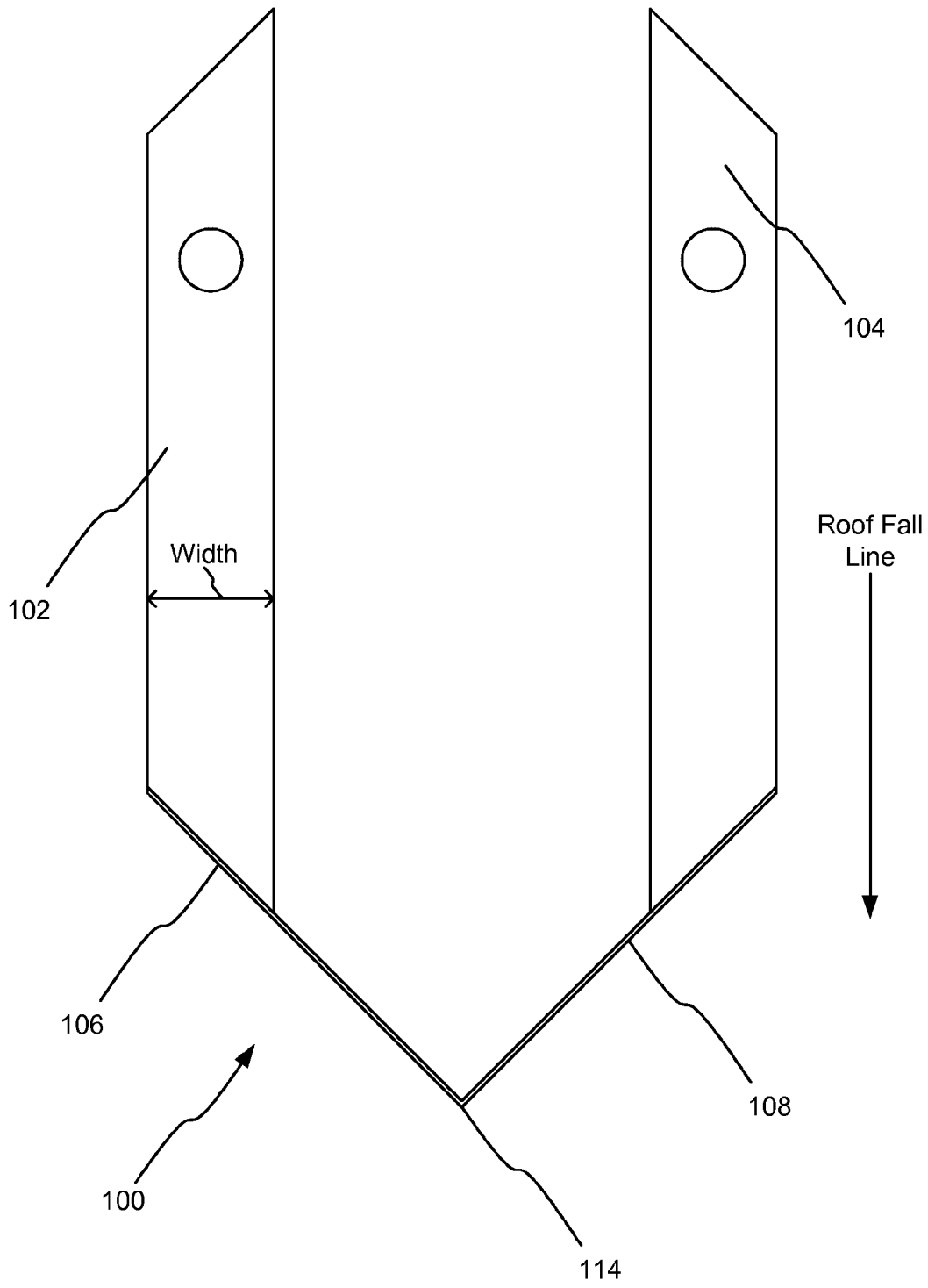
FIG. 2 illustrates an overhead view of the folded snow stop of FIG. 1.

FIG. 2 also illustrates that the feet 102, 104 can be at a 90° angle, or a substantially 90° angle, to the first and second stopping portions 106, 108. Further, in the illustrated embodiment, the third fold line 114 is at a 90° angle, or a substantially 90° angle, to the feet 102, 104. This can also be seen in FIG. 4, but in FIG. 4 the folded snow stop 100 is secured to a roof such that the third fold line 114 is at an angle to a gravitational plumb line. In other embodiments the fold lines 110, 112, 114 can be arranged such that the third fold line 114 is other then perpendicular or substantially perpendicular to the feet 102, 104. In other embodiments, the third fold line 114 can be parallel to a gravitational plumb line. Functionally, the angle of the third fold line 114 relative to the roofline can be any angle that enables water impacting the first and second stopping portion 106, 108 to travel under the first and second stopping portions 106, 108 and through the opening 116.

The folded snow stop 100 can be created by the folding of the flat snow stop 500 or 600 as seen in FIGS. 5 and 6, respectively. The first and second stopping portions 106, 108 are folded upward away from the roof surface and meet at the third fold line 114 creating a stable triangular opening 116.

In some non-illustrated variations, the feet 102, 104 can include hooks on ends of the feet 102, 104 that can hook onto or into the roof (e.g., around tile, slate or metal interlocking shingles) to help secure the folded snow stop 100 to the roof or other structure.

In other variations, the dimensions of the folded snow stop 100 can vary. For instance, the feet 102, 104 can be longer and/or wider. In other variations, the angles formed when the snow stop is folded along the fold lines 110, 112, 114 can vary from those that are illustrated. In other embodiments, the positions of the first and second one or more fastening apertures 118, 120 in the first and second feet 102, 104 can vary from those illustrated.

Figure 3:
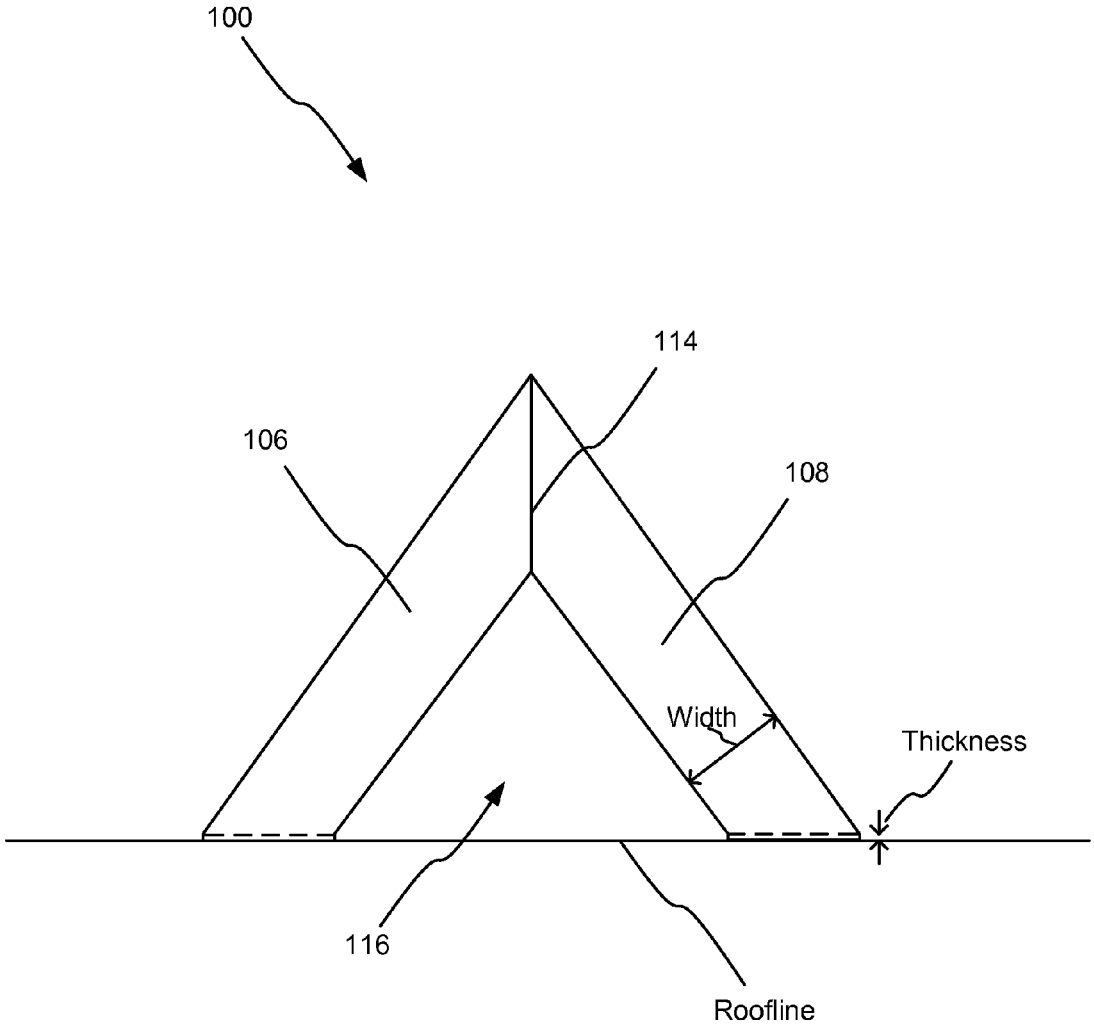
FIG. 3 illustrates a front view of the folded snow stop of FIG. 1.

FIG. 3 illustrates a front view of the folded snow stop 100 of FIGS. 1 and 2. Here the first and second stopping portions 106, 108 can be seen to rise above the roofline and form the opening 116 through which snow melt can flow. The roof fall line, and thus the flow of water, is out of the page. The first and second stopping portions 106, 108 act as a cleat to stop snow and ice from moving down the roof fall line.

Figure 4:
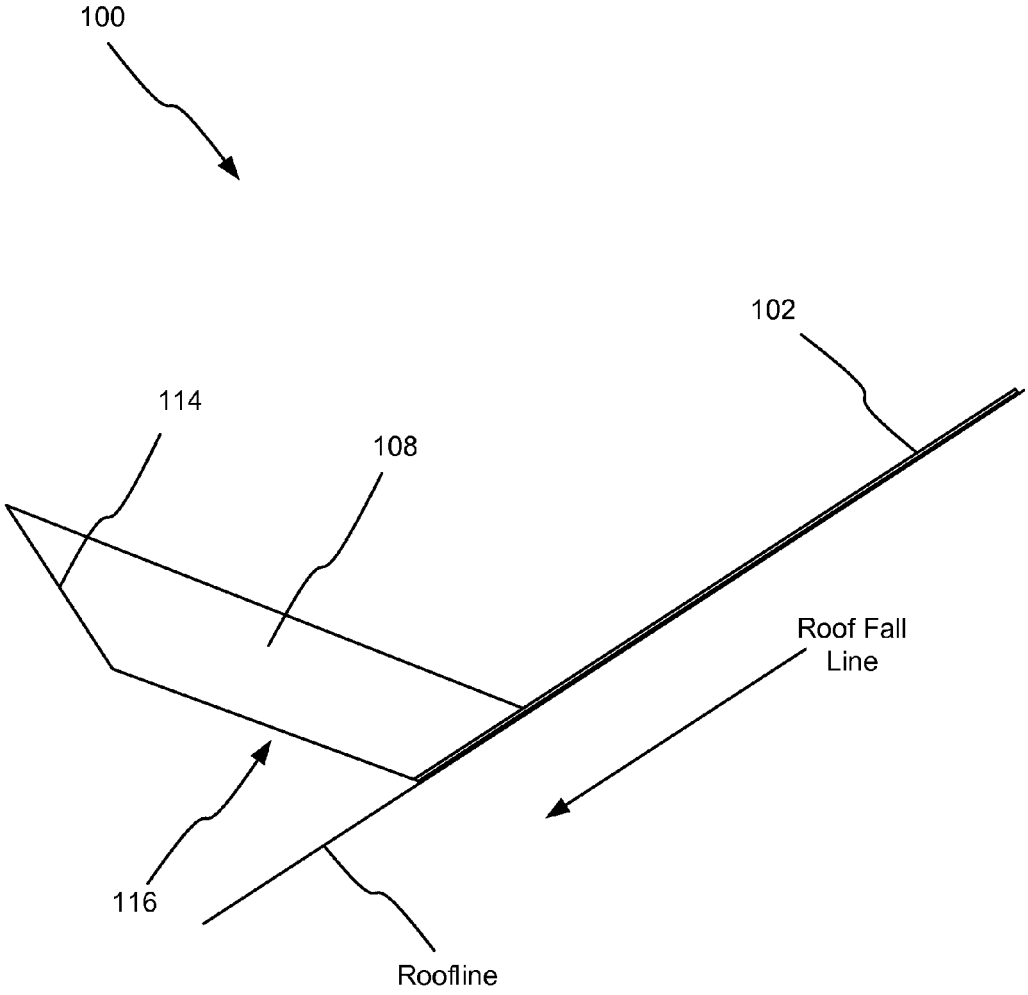
FIG. 4 illustrates a side view of the folded snow stop of FIG. 1.

FIG. 4 illustrates a side view of the folded snow stop 100 of FIG. 1 as secured to a roof. From this side view one can see that the feet 102, 104 can be flush with the roofline or other structure while the first and second stopping portions 106, 108 are folded such that they rise above the roofline or other structure in order to impede the flow of snow and ice down the roof. At the same time, opening 116 allows snowmelt to pass through the folded snow stop 100.

One of skill in the art will recognize that the raised portions 616, 618, 620, 622 are optional, and as described with reference to FIGS. 1-5, there are embodiments where the raised portions 616, 618, 620, 622 are not implemented. The size, shape, and arrangement of the raised portions 616, 618, 620, 622 are illustrative only. Other sizes, shapes, and arrangements are also possible, and different layouts may be used for different roof styles and different snow stop materials.

Figure 7:
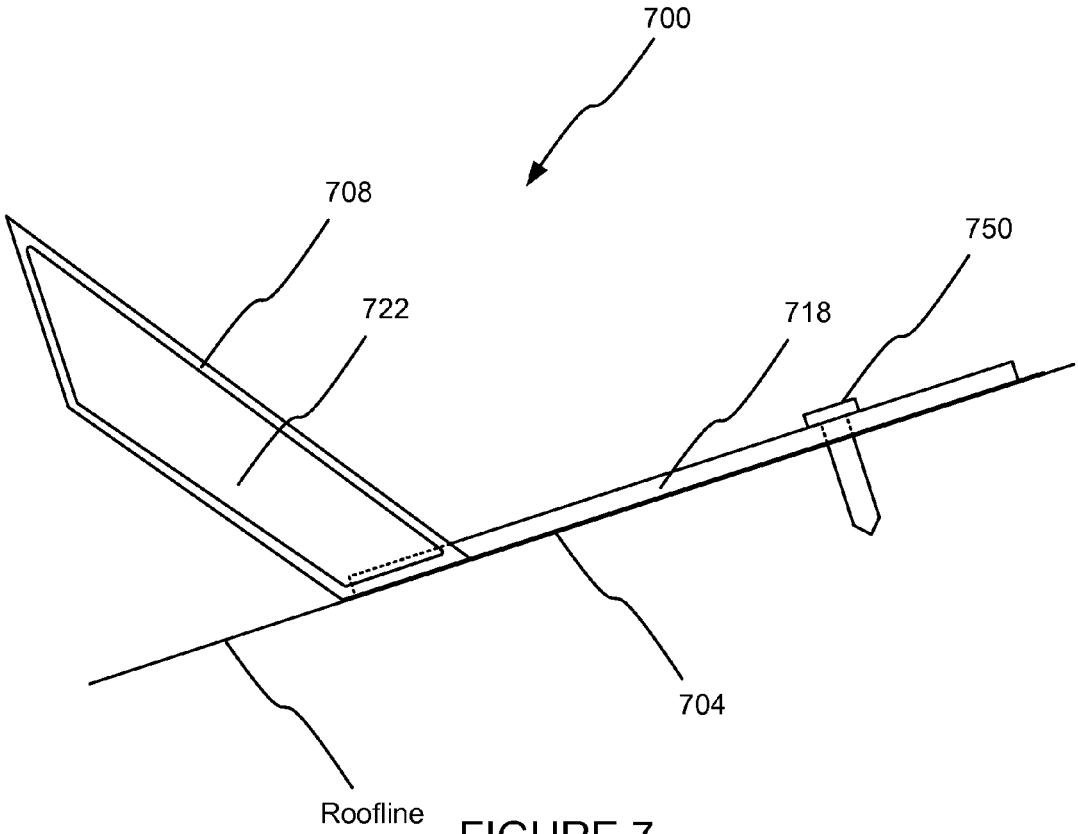
FIG. 7 illustrates a side view of a folded snow stop formed from a flat snow stop having raised portions such as the one illustrated in FIG. 6.

FIG. 7 illustrates a similar side view of a folded snow stop 700, but in this case the folded snow stop 700 is formed from a flat snow stop having raised portions such as the flat snow stop 600 illustrated in FIG. 6. A first raised portion is not visible, while a second raised portion 718 formed into a second foot 704 is visible. The raised portion 718 can form a hollow space 718 within the raised portion 718. A fastener 750 (e.g., a bolt, nail, screw) can be arranged through a fastening aperture in the second foot 704 to affix the folded snow stop 700 to the roof. A substance, such as an adhesive or sealant, can be arranged to fill at least a portion of the hollow space 718 and arranged to envelop a portion of the fastener 750 within the hollow space 718 so as to prevent liquid from passing through the first one or more fastening apertures of the second foot 704 and thereby prevent the liquid from reaching the roof. The substance can prevent snow melt and rain water from passing through the fastening aperture and through a hole in the roof formed by the insertion of the fastener 750 (e.g., a screw hole).

The first and second stopping portions (only the second stopping portion 708 being visible from this side view) can include third and fourth raised portions, respectively (only the fourth raised portion 722 being visible from this side view).

The systems, methods, and apparatus herein disclosed overcome the challenges posed by prior art snow stops by creating a stable and strong element from a flat strip of material and causing the snow stop to stop snow while allowing snow melt to flow through and around the snow stop due to the absence of surfaces perpendicular to the flow of water, snow, and ice. This disclosure also enables a flat snow stop that can be hand folded in the field into a folded snow stop, where the flat snow stop is inexpensively manufactured and easily manageable. This product and process avoids the need for cutting or folding tools in order to convert the snow stop from a transportable form (the flat snow stop) to a ready-for-installation product (the folded snow stop). Raised portions form fold lines that allow any installer to easily fold the snow stops by hand and in a repeatable and consistent fashion. The raised portions also help hold stacks of flat snow stops together and enhance structural strength of the folded snow stop.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A flat snow stop configured for transport in a flat form and configured to then be bent by hand into a folded snow stop at an installation site, the flat snow stop comprising:

a chevron-shaped foldable component having greater width than thickness and being separated into:

a first foot having a first raised portion;

a second foot having a second raised portion;

a first stopping portion having a third raised portion; and a second stopping portion having a fourth raised portion;

a first fold line formed by and between the first and third raised portions;

a second fold line formed by and between the second and fourth raised portions; and a third fold line formed by and between the third and fourth raised portions, wherein the first and second fold lines are in line with each other, and wherein the third fold line is perpendicular to the first and second fold lines.

2. The flat snow stop of claim 1, wherein the flat snow stop is shaped so as to lie flush atop and/or below another flat snow stop for transport, although not atop and below at the same time.

3. The flat snow stop of claim 2, wherein the first, second, third, and fourth raised portions are shaped so as to fit flush atop and below raised portions of the another flat snow stop, although not atop and below at the same time.

4. The flat snow stop of claim 3, further comprising:

a first one or more fastening apertures of the first foot configured for securing the flat snow stop to a structure; and a second one or more fastening apertures of the second foot configured for securing the flat snow stop to the structure.

* * * * *